US005657815A

United States Patent [19]

Sugitani

[11] Patent Number: 5,657,815

[45] Date of Patent: Aug. 19, 1997

[54] METHOD AND APPARATUS FOR PRODUCING A COMPOSITE OF PARTICULATE INORGANIC MATERIAL AND METAL

[75] Inventor: Nobuhiro Sugitani, Tokyo, Japan

[73] Assignee: Sugitani Kinzoku Kogyo Kabushiki Kaisha, Tokyo, Japan

[21] Appl. No.: 574,197

[22] Filed: Dec. 18, 1995

[30] Foreign Application Priority Data

| | | | |
|---|---|---|---|
| Dec. 22, 1994 | [JP] | Japan | 6-320967 |
| Mar. 2, 1995 | [JP] | Japan | 7-042954 |
| Mar. 2, 1995 | [JP] | Japan | 7-042955 |
| May 15, 1995 | [JP] | Japan | 7-116156 |

[51] Int. Cl.[6] ..... B22D 19/14

[52] U.S. Cl. ..... 164/461; 164/97

[58] Field of Search ..... 164/461, 97, 900, 164/133, 312, 113, 119, 306

[56] References Cited

U.S. PATENT DOCUMENTS

| | | | |
|---|---|---|---|
| 2,433,903 | 1/1948 | Hensel et al. | 164/461 |
| 3,110,939 | 11/1963 | Lockwood | 164/97 |
| 3,470,939 | 10/1969 | Coad | 164/461 |
| 3,862,657 | 1/1975 | Thalmann | 164/461 |
| 4,583,580 | 4/1986 | Hunt | 164/900 |
| 4,961,461 | 10/1990 | Klier et al. | 164/461 |
| 5,040,589 | 8/1991 | Bradley et al. | 164/900 |
| 5,348,071 | 9/1994 | Cook | 164/97 |

FOREIGN PATENT DOCUMENTS

| | | | |
|---|---|---|---|
| 53-46175 | 2/1978 | Japan | 164/97 |
| 61-132264 | 6/1986 | Japan | 164/97 |

*Primary Examiner*—Kuang Y. Lin

*Attorney, Agent, or Firm*—Kane, Dalsimer, Sullivan, Kurucz, Levy, Eisele and Richard, LLP

[57] ABSTRACT

A process and an apparatus for producing a composite of a particulate inorganic material, such as Shirasu balloons, and a metal, such as aluminum, in four inventive aspects. The composite is produced successively by the process steps comprising charging a mold cavity of a mold with the particulate inorganic material to form an aggregation of the particles, injecting a molten metal into the aggregation through a molten metal permeable refractory partition wall from a molten metal storage vessel, forwarding the resulting aggregation impregnated with the molten metal, cooling the impregnated aggregation to solidify and taking the solidified molded composite out of the mold. The composite according to the present invention is stout, light weighing, non-inflammable and easily processible and exhibits high dimensional stability and uniform distribution of the material properties, so that it can be used for construction and architecture purposes.

28 Claims, 7 Drawing Sheets

METHOD AND APPARATUS FOR PRODUCING A COMPOSITE OF PARTICULATE INORGANIC MATERIAL AND METAL

FIELD OF THE INVENTION

The present invention relates to a method for producing a composite product of an inorganic material and a metal and to an apparatus therefor.

BACKGROUND OF THE INVENTION

For utilizing a hollow spherical particulate material, such as a calcined natural glass sand (Shirasu-balloons), for producing boards and blocks, a process is necessary for shaping (molding) it, while bonding the particles using a binding material. As the binding material, for example, resins, cements and sodium silicates have found their application therefor. Use of resins will result in a reduction of non-inflammability of the product, while use of cements may impair the contemplated light-weighing property and processibility of the product and use of sodium silicates may bring about inferior strength and lower processibility of the product.

A technique of producing composite boards has been known (Japanese Patent Application No.320967/1994), which comprises charging a mold cavity in a form of a plate with a hollow spherical particulate material and filling up the interstices of the charged particles with a molten metal, such as aluminum, to be used as the binding material, by impressing the molten metal into the mold cavity under a pneumatic pressure to soak the charged hollow particulate material. This technique has, however, defects that the dimensions of the composite board to be produced are limited to the range in which the flowability of the molten metal for soaking the hollow particles in the mold cavity can be maintained and that there is a large irregularity in the degree of filling up of the particle interstices with the metal over the product board, so that, even approximately, a homogeneous filling up and, therefore, uniformity of the material properties of the product board, cannot be achieved. These defects become increased when the board has greater extension or is thinner. For these reasons, this technique has not been in practice for the production of boards.

Processes of prior art for continuous production of uniform composites of inorganic material and metal are reviewed in our prior patent application (Japanese Patent Application No. 320967/1994, see above). A continuous production of boards may permit to expect a reduction in the production cost due to the high productivity, nevertheless there is a limitation in the design of the ornamental surface profile pattern on the board required for commercializing such boards. Thus, it is not able to produce a composite board having a surface profile of, for example, an undercut with a projection protruding rectangularly to the direction of sliding of the composite board along the inside face of the metal mold upon the production thereof. While it may be considered that a surface profile can be brought about by a roller embossing or a plate embossing after the composite board has been molded, such a measure may deteriorate the ornamental effect of the composite board due to the possible break down of the hollow particles of the inorganic material upon the embossing, since these hollow particles appear even within a quite shallow depth in the skin layer of the composite. For these reasons, the surface profile patterns achieved by the conventional continuous production techniques are limited to those in which the embossing patterns are quite shallow, e.g., hair-thick lines and the like, and run parallel with a constant width only in the direction of sliding of the composite board performed in the production thereof.

For producing a board or a block from hollow particulate material, the particles must be bonded rigidly together by, for example, using a binder. For such a binder, resins, cements, sodium silicates and others are used. Use of a synthetic resin for such a binder will result in a poor non-inflammability of the product. Use of cement will lead to a heavy-weighing product with poor processibility and use of sodium silicates brings about a product with lower strength and inferior processibility.

A technique has been known for producing a composite product from a hollow particulate material, which comprises filling up a plate-shaped mold cavity of a metal mold with the hollow particulate material and injecting therein a molten metal, such as aluminum, by impressing it by a pneumatic or a mechanical means to penetrate through the interstices between the particles, in order to bind the particles rigidly with each other by the metal as a medium for binding the particles.

This technique can only be applied to the case where the thickness of the product board allows a free flow of the molten metal to penetrate into the interstices between the particles. Thus, an allowable charging ratio of the molten metal to the particulate material, namely, a permissible uniformity in the material properties of the product composite can only difficulty be achieved.

The difficulties of the prior techniques as given above become more and more larger for products of greater size and lower thickness. For this reason, these techniques are still not in practical use for the production of composite board.

A technique has also been contrived, in which a molten metal is injected into a horizontally laying plate-shaped aggregation of a hollow particulate material in a horizontal mold from above to produce a composite impregnated with the metal. Here, the mold is provided at a portion thereof with a preheater to preheat the plate-shaped aggregation. However, due to the relationship between the geometry of the mold and the possible sliding velocity of the plate-shaped aggregation, it is difficult to choose a high preheating temperature of the aggregation of the particulate material. If the preheating temperature too low, it is necessary to increase the pressure for injecting the molten metal into the aggregation in order to attain penetration into the interstices between the particles. This pressure calculates to be doubled as compared with the case of bilateral injection of the molten metal, since the penetration depth is doubled. If the injecting pressure is increased, the proportion of collapse of the hollow particles due to compression increases, resulting in an increase in the apparent density of the composite board obtained. A higher injecting pressure brings about a further defective effect of necessitating an increase in the strength of the molten metal storage vessel. A disadvantageous measure may be necessary for evading these defective effects, for example, by incorporating a greater heat source, in order to attain a prompt preheating of the hollow particulate inorganic material.

Various processes have been contrived for producing a composite of metal and hollow particles of inorganic material and some have found their practical applications. All of these prior processes are fundamentally based on the principle of compressingly impregnating the particles with a molten metal in a static condition. The compressive impregnation becomes more difficult, as the thickness of the particle layer increases and the path for the penetration of the molten metal becomes longer. A principal cause of such increase in the difficulty of impregnation may be the circumstances that the stream of the molten metal upon penetration into the aggregation of the particles on passing through the quite narrow interstices between the particles will be branched into thin streamlets of very small diameters which may be liable to a rapid quench and solidification, losing thus rapidly their fluidity and blocking up the flow. If this difficulty is overcome by forcing the molten metal to penetrate the aggregation of the particles by impressing it into the interstices between the particles, some bulky streams of the molten metal will appear up to some depth by wedging the hollow particles away, before they branch into dendritic very thin streamlets. Within the bulky stream, the hollow particles may be collapsed and the molten metal fills up the particle inside to deteriorate the characteristic feature of light-weighing of the composite and there is a large local inequality in the material properties between the portion of the bulky stream and the portion of the dendritic streamlets. In order to obviate these disadvantages, a new technique was proposed and a corresponding patent application was made (Japanese Patent Application Ser. No. 320967/1994), in which a molten metal is injected into a board-like aggregation of the hollow particulate inorganic material held in the mold cavity, through perforations of a perforated plate which covers only a restricted area of one side face of the mold cavity, by pneumatically impressing the molten metal with a relatively low compressive force (1.5–2.5 kgf/cm$^2$) so as to attain the penetration of the molten metal in the direction of thickness of the board in which the path of penetration is at the smallest. This technique has been proven experimentally to be a process for producing a composite board of a metal and a hollow particulate inorganic material exhibiting the lowermost local inequality in the material properties. This material property inequality which is the principal disadvantage of this technique increases, however, in proportion to the thickness of the bulk of aggregation for a composite product of a thick aggregation, such as a block, cylinder of larger diameter or the like, since the molten metal permeates through the interstices between the particles in the aggregation. It has therefore been expected to provide a method for producing composite products of a metal and a hollow particulate inorganic material with greater bulk thickness, by which such a local inequality in the material properties of the resulting composite product is minimized.

SUMMARY OF THE INVENTION

The first object of the present invention is to obviate the above-mentioned disadvantages of the prior art processes and to provide novel processes and novel apparatuses for producing an extended relatively thin product of a composite of a metal and a hollow particulate inorganic material exhibiting a lower local inequality in the material properties of the resulting product.

The second object of the present invention is to provide another novel process and a novel apparatus adapted for producing an extended product of a composite of a metal and a hollow particulate inorganic material having a voluntarily designed surface relief pattern and exhibiting a lower local inequality in the material properties of the resulting product, in a continuous manner without limitation of the extension of the resulting composite product.

The third object of the present invention is to provide a further novel process and a novel apparatus for producing an extended product of a composite of a metal and a hollow particulate inorganic material in a form of a board, cylinder or block, in a continuous way with continuous charging of the hollow particulate inorganic material to a stationary passing mold.

The fourth object of the present invention is to obviate the disadvantages of the prior art processes and to provide a still further novel process and a novel apparatus adapted for producing an extended product of a composite of a metal and a hollow particulate inorganic material having a greater bulk thickness and exhibiting a lower local inequality in the material properties of the resulting product, in a continuous way without limitation in the extension of the product using a high-temperature mixer extruder.

The above-mentioned first object of the present invention can be achieved according to the first–fourth aspects of the present invention.

More specifically, the first object of the present invention is attained, in the first place, by a process for producing an extended relatively thin composite product of a metal and a hollow particulate inorganic material using a mold assembly which is constituted essentially of a mold enclosing a mold cavity of a geometry corresponding to the extended product, a means for charging the mold cavity with the hollow particulate inorganic material, a storage vessel for storing the molten metal, a molten metal permeable perforated or porous refractory plate located on one side of the extension of the mold cavity and adjoining the molten metal in said storage vessel and a means for taking the molded composite product out of the mold cavity, said process comprising the process steps of filling up the mold cavity of the mold with the hollow particulate inorganic material to build up an aggregation of the particulate inorganic material in a form corresponding to the mold cavity, injecting the molten metal into the aggregation of the particulate inorganic material in the mold cavity through the molten metal permeable perforated or porous plate to cause the molten metal to penetrate into the interstices between the particles in the aggregation by pneumatically impressing the molten metal in the molten metal storage vessel, permitting the resulting product composed of the aggregation of the particulate inorganic material and the molten metal penetrated said aggregate to solidify into the extended product of the composite of metal and hollow particulate inorganic material and taking the solidified composite product out of the mold cavity.

The above-mentioned first object of the present invention is also achieved, in the second place, by a process for producing an extended relatively thin composite product of a metal and a hollow particulate inorganic material using a mold assembly which is constituted essentially of a mold enclosing a mold cavity subdivided at an equal interval into an entrance section, a central section and an exit section each having the same geometry corresponding to the extended product; a means for charging the entrance section of the mold cavity with the hollow particulate inorganic material; a means for forwarding the resulting aggregation slidingly stepwise successively from the entrance section to the central and the exit sections and, finally, to the outside of the mold; a storage vessel for storing the molten metal; a molten metal permeable perforated or porous refractory plate located on one side of the extension of the mold cavity and adjoining to the molten metal in said storage vessel; and a means for taking the molded composite product out of the mold, said process comprising repeating the process steps of filling up the entrance section of the mold cavity with the hollow particulate inorganic material to build up an aggregation of the particulate inorganic material therein in a form corresponding to the mold cavity of the entrance section, forwarding this aggregation slidingly stepwise, first, to the central section of the mold cavity, injecting the molten metal into the particle aggregation in the central section of the mold cavity through the molten metal permeable perforated or porous plate to cause the molten metal to penetrate the aggregation through the interstices between the particles of said aggregation of the hollow particulate inorganic material by pneumatically impressing the molten metal in the molten metal storage vessel, while re-filling the now vacant entrance section with fresh hollow particulate inorganic material, forwarding, then, the aggregation found in the central section and now impregnated with the molten metal slidingly stepwise to the exit section of the mold cavity, while repeating the above re-filling and injecting steps, cooling, thereafter, the resulting molded product in the exit section of the mold cavity to solidify it into the extended product of the composite of metal and hollow particulate inorganic material, forwarding, then, the aggregations in the three sections slidingly stepwise further to move the solidified product to the outside of the mold, while repeating the above process steps, and taking the finished molded composite product out of the mold assembly in the discharge station.

The above-mentioned first object of the present invention is also achieved, in the third place, by a novel apparatus for producing an extended relatively thin composite product of a metal and a hollow particulate inorganic material, comprising a mold assembly which comprises a mold enclosing a mold cavity of a geometry corresponding to that of the extended composite product, a means for charging the mold cavity with the hollow particulate inorganic material to fill it up and to shape it into an aggregation of the hollow particulate inorganic material, a means for slidingly forwarding the aggregation of the hollow particulate inorganic material from the charging end to a discharge station of the mold assembly, a storage vessel for storing the molten metal and adapted to be pneumatically impressed for effecting injection of the molten metal into the mold cavity, a molten metal permeable perforated or porous refractory plate for injecting the molten metal there-through into the aggregation of the hollow particulate inorganic material in the mold cavity, located on one side of the extension of the mold cavity and adjoining to the molten metal in said storage vessel, with its perforations or pore channels being distributed over the plate and each having a diameter adapted to permit the molten metal to be injected therethrough into the aggregation upon the pneumatic impression but not adapted to permit the hollow particles of the inorganic material in the aggregation to intrude into the molten metal in said storage vessel and a means for taking the molded composite product out of the mold cavity at the discharge station.

The above-mentioned first object of the present invention is also achieved furthermore, in the fourth place, by a novel apparatus for producing an extended relatively thin composite product of a metal and a hollow particulate inorganic material successively, comprising a mold assembly which comprises a mold enclosing a mold cavity subdivided at an equal interval into an entrance section, a central section and an exit section each having the same profile geometry as that of the extended product, a means for charging the entrance section of the mold cavity with the hollow particulate inorganic material to fill it up and to build up an aggregation of the hollow particulate inorganic material therein, a means for slidingly forwarding stepwise the aggregation of the hollow particulate inorganic material in the entrance section successively to the central and the exit sections of the mold cavity and, finally, to the discharge station of the mold assembly, a storage vessel for storing the molten metal, located adjacent the mold cavity and adapted to be pneumatically impressed for effecting injection of the molten metal into the central section of the mold cavity, a molten metal permeable perforated or porous refractory plate for injecting the molten metal therethrough into the aggregation of the hollow particulate inorganic material in the mold cavity, disposed on one side of the extension of the mold cavity and adjoining to the molten metal in said storage vessel, with its perforations or pore channels being distributed over the plate and each having a diameter adapted to permit the molten metal to be injected therethrough into the aggregation upon the pneumatic impression but not adapted to permit the hollow particles of the inorganic material in the aggregation to intrude into the molten metal in said storage vessel, and a means for taking the molded composite product out of the mold cavity at the discharge station.

The above-mentioned second object of the present invention can be attained according to the fifth and sixth aspects of the present invention.

More specifically, the second object of the present invention is attained by a novel process for producing an extended relatively thin product of a composite of a metal and a hollow particulate inorganic material having a voluntarily designed surface relief pattern successively using a mold assembly constituted essentially of mold elements enclosing a mold cavity having a profile geometry corresponding to that of the extended product of the composite and composed of a plurality of mold bottom segments slidably movable on a mold bed and on inlet side and outlet side mold guide, respectively, and a molten metal permeable stationary perforated or porous refractory plate; a means for charging the mold cavity with said hollow particulate inorganic material; and a storage vessel for storing the molten metal, with its bottom being constituted of said molten metal permeable perforated or porous refractory plate, said process comprising, under repetition, the process steps of laying the mold bottom segments serially on the mold bed to form a mold bed train, filling up the mold cavity on the mold bottom segment at the mold inlet with the hollow particulate inorganic material to build up an aggregation of the particulate inorganic material in a form corresponding to the mold cavity, forwarding the mold bottom train slidingly on a mold guide way and on the mold bed together with the aggregation of the hollow particulate inorganic material towards the mold outlet, injecting the molten metal into the mold cavity through the molten metal permeable perforated or porous refractory plate constituting the bottom of the molten metal storage vessel by pneumatically impressing the molten metal in the molten metal storage vessel to cause the molten metal to penetrate the aggregation through the interstices between the particles of the aggregation, taking out the molded extended composite product impregnated with the molten metal from the mold bottom segment left the mold as the mold bottom moves on, and removing the foremost mold bottom segment now freed from the molded composite product at the mold outlet end from the outlet side mold guide way and laying it again on the inlet side mold guide way to supplement the mold bottom train.

The second object of the present invention is also attained by a novel apparatus for producing an extended relatively thin product of a composite of a metal and a hollow particulate inorganic material having a voluntarily designed surface relief pattern successively, comprising a mold assembly constituted essentially of mold elements enclosing a mold cavity having a profile geometry corresponding to that of the extended product of the composite and composed of a plurality of mold bottom segments, which are arranged in a tight but separable fitting with each other to build up a trough-formed mold bottom train slidably movable on a mold guide way and on a mold bed and each of which has a voluntarily designed surface relief pattern on the upper face thereof, and a molten metal permeable stationary perforated or porous refractory plate defining the upper limit of the mold cavity, a means for charging the mold cavity with said hollow particulate inorganic material to build up an aggregation of the hollow particles of the inorganic material in the mold cavity, a means for forwarding the mold bottom train slidingly on the mold guide way and on the mold bed together with said aggregation of the particulate inorganic material carried thereon, from the inlet side to the outlet side of the mold assembly, a storage vessel for storing the molten metal disposed on the molten metal permeable stationary perforated or porous refractory plate and adapted to be pneumatically impressed for effecting injection of the molten metal into the mold cavity charged with the aggregation of the hollow particulate inorganic material through the molten metal permeable stationary perforated or porous refractory plate, said perforations or pore channels being distributed over the plate and each having a diameter adapted to permit the molten metal to be injected therethrough into the aggregation of the particles of the inorganic material upon the pneumatic impression of the molten metal but not adapted to permit the particles of the inorganic material to intrude into the molten metal in said storage vessel, and a means for taking out the molded extended composite product from the moved mold bottom segment moved and leaving the mold cavity.

The third object of the present invention can be attained according to the seventh and eighth aspects of the present invention.

More specifically, the third object of the present invention is attained by a novel process for producing an extended product of a composite of a metal and a hollow particulate inorganic material in a form of a board, cylinder or block, in a continuous way with continuous charging of the hollow particulate inorganic material using a mold assembly constituted essentially of a stationary passage mold enclosing an extended mold cavity and subdivided into a preheating zone accommodated in a molten metal storage vessel, a molten metal injection zone of molten metal permeable perforated or porous part, with its perforations or pore channels being distributed over this zone, immersed in the molten metal for permitting injection of the molten metal into the mold cavity therethrough and a cooling zone in the mold exit end portion; an assembly for charging the mold cavity with said hollow particulate inorganic material at the mold inlet; and a towing means for pulling down the resulting extended composite product to be discharged out of the mold, said process comprising the process steps of charging the mold cavity at the mold inlet with the hollow particulate inorganic material to build up an aggregation of the hollow particulate inorganic material in a cross-sectional profile corresponding to that of the mold cavity, forwarding the resulting aggregation of the particulate inorganic material slidingly towards the mold exit by the action of the towing means, injecting the molten metal into the mold cavity through the molten metal permeable perforated or porous part of the passage mold to cause the molten metal to penetrate the aggregation of the particulate inorganic material though the interstices between the particles of the aggregation by a static pressure head of the molten metal in the molten metal storage vessel and, if necessary, under a pneumatic pressure control in the molten metal storage vessel, cooling the aggregate impregnated with the molten metal in the cooling zone of the stationary mold to solidify it and taking the so-solidified extended composite product out of the mold under the use of the towing means.

The third object of the present invention is also attained by a novel apparatus for producing an extended product of a composite of a metal and a hollow particulate inorganic material in a form of a board, cylinder or block, in a continuous way with continuous charging of the hollow particulate inorganic material, said apparatus comprising a mold assembly which comprises an extended stationary passage mold enclosing an extended mold cavity having a cross-sectional profile geometry corresponding to that of the extended product of the composite passing therethrough and subdivided into a preheating zone accommodated in a molten metal storage vessel, a molten metal injection zone of molten metal permeable perforated or porous part, with its perforations or porechannels being distributed over this zone, immersed in the molten metal for permitting injection of the molten metal into the mold cavity therethrough provided with perforations distributed over this zone and a cooling zone in the mold outlet end portion for cooling and solidifying the molded product in the mold cavity, an assembly for charging the mold cavity with the hollow particulate inorganic material at the mold inlet to build up an aggregation of the particulate inorganic material in the mold cavity and a towing means for pulling out the resulting extended composite product from the mold cavity, disposed subsequent to the mold outlet.

The fourth object of the present invention can be attained according to the ninth and tenth aspects of the present invention More specifically, the fourth object of the present invention is attained by a novel process for producing an extended shaped product of a composite of a metal and a hollow particulate inorganic material having a relatively greater bulk thickness in a form of, such as, a board, cylinder, block or so on, in a continuous way using a molding apparatus constituted essentially of a high temperature mixer extruder for mixing the hollow particulate inorganic material with the molten metal and extruding the resulting mixture from an extruding nozzle; a means for supplying the mixer extruder with the hollow particulate inorganic material; a means for supplying mixer extruder with the molten metal; and a shaping unit for shaping the mixture extruded from the mixer extruder into the final shaped product of the composite, said process comprising the process steps of mixing the hollow particulate inorganic material and the molten metal on the mixer extruder, extruding the resulting mixture into the shaping unit to shape it into a shaped green product, cooling the shaped green product to solidify into the final product and taking this product out of the shaping unit.

The fourth object of the present invention is attained also by a novel apparatus for producing an extended shaped product of a composite of a metal and a hollow particulate inorganic material having a relatively greater bulk thickness in a form of, such as, a board, cylinder, block or so on, in a continuous way, comprising a molten metal storage vessel, a high-temperature mixer extruder for mixing the particulate inorganic material with the molten metal and for extruding the resulting mixture from an extruding nozzle, said mixer extruder having a refractory casing cylinder capable of being heated to a temperature above the solidifying point of the molten metal, a means for supplying the mixer extruder with the hollow particulate inorganic material, a means for supplying the mixer extruder with the molten metal and a shaping unit for shaping the mixture extruded from the mixer extruder into the final shaped product of the composite.

DETAILED DESCRIPTION OF THE INVENTION

First, the process for producing an extended composite product of a particulate inorganic material and a metal according to the present invention is described in detail, in particular, for the cases of successive production of the composite product using a horizontally laid molding assembly, based on the first embodiment thereof with reference to FIGS. 1 to 4.

Figure 1:
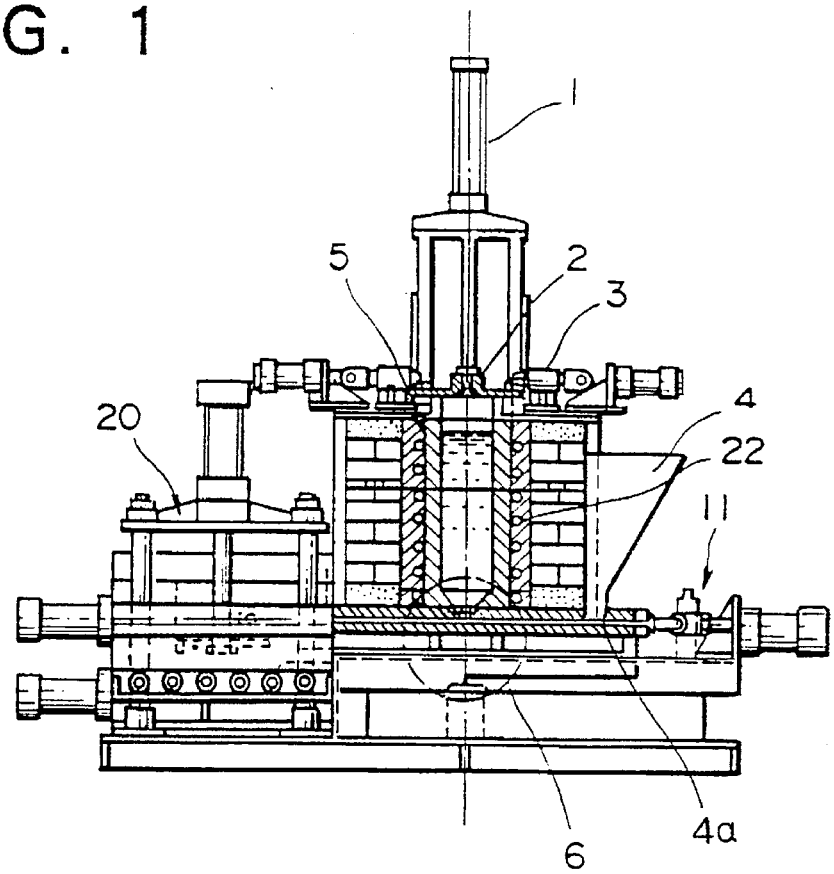
FIG. 1 shows the first embodiment of the apparatus for producing a composite product of a particulate inorganic material and a metal according to the present invention in a vertical section.
Figure 2:
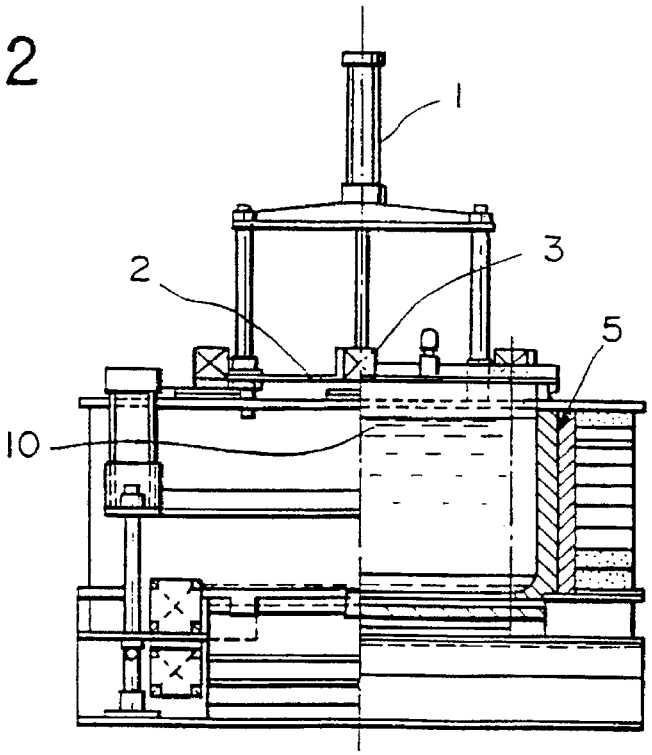
FIG. 2 is a partly sectioned side view of the principal portion of the apparatus of FIG. 1.
Figure 3:
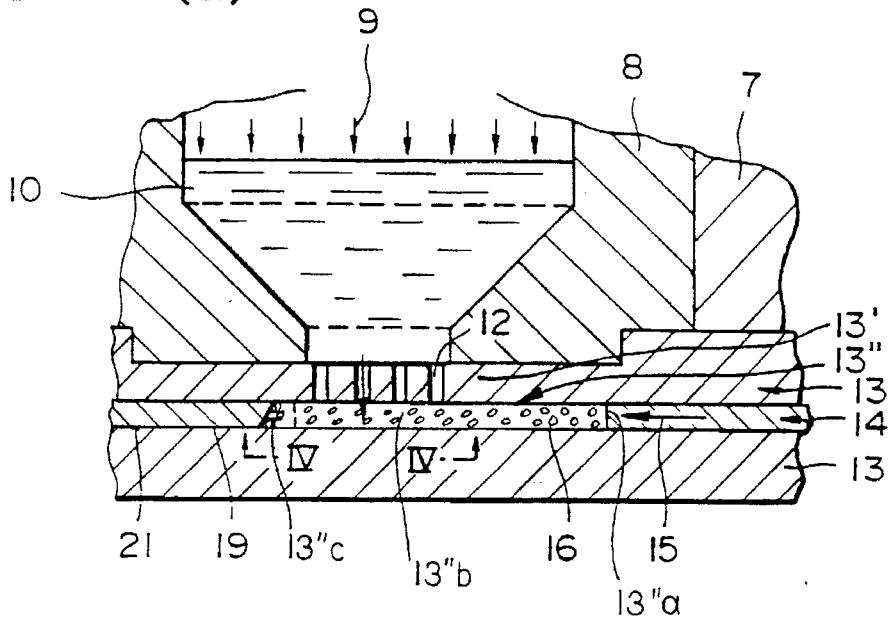
FIGS. 3(*a*) and 3(*b*) show each the essential portion for injecting molten metal into the mold cavity filled with an aggregation of the particulate inorganic material in an enlarged vertical section, wherein FIG. 3(*a*) shows the state during the molten metal injection and FIG. 3(*b*) shows the state upon slidingly forwarding the resulting composite after the metal impregnation.
Figure 3:
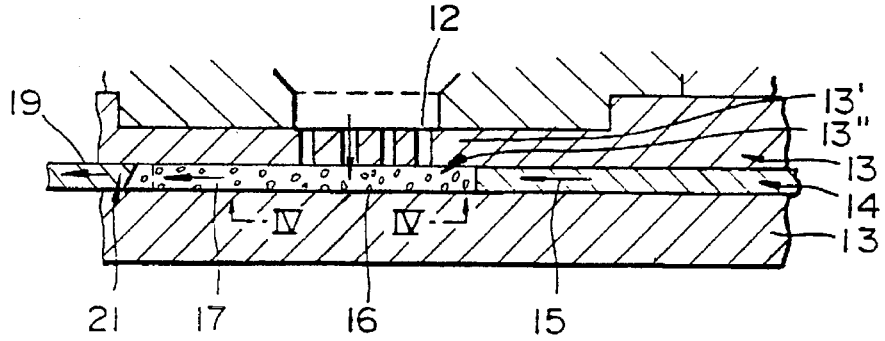
Figure 4:
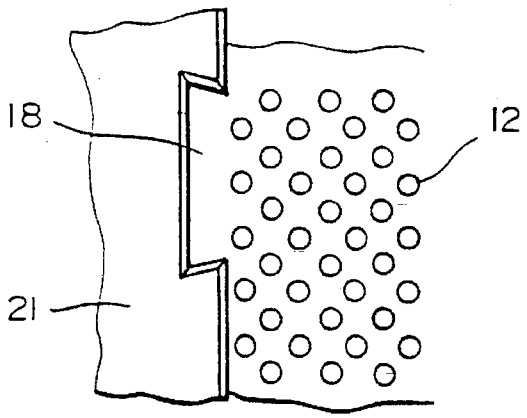
FIG. 4 shows a part of the horizontal section of the perforated plate along the line IV—IV of FIG. 3 in an enlarged view.

The entire apparatus can be seen from FIGS. 1 and 2, in which 1 is a gas-tight lid operating cylinder, 2 is a gas-light lid, 3 denotes a gas-tight lid fixing member, 4 designates a particulate inorganic material hopper which is supplied with the hollow particulate inorganic material by, for example, a belt conveyer and 5 is a storage vessel (crucible furnace) for storing the molten metal. The essential portion of the apparatus where the molten metal is injected into the aggregation of the particulate inorganic material is indicated by 6. The hopper 4 adjoins at its bottom to the inlet of the mold cavity via an opening permitted to open and close voluntarily.

In the portion 6, the crucible furnace 5 is surrounded by a heat insulator wall 7 constituted of refractory bricks and a binding plaster for preventing dissipation of heat. In the crucible 8 of the crucible furnace 5, a molten metal 10 is stored. The molten metal 10 is pneumatically impressed, as shown by the arrows 9. The gas-tight lid 2 is brought down by an action of the gas-tight lid operating cylinder 1 and closes the furnace 5. The crucible 8 is sealed tightly by means of a lid fixing member 3, whereupon the gas space of the crucible is supplied with a compressed air through an air supply path provided in the gas-tight lid 2 to impress the molten metal 10. An operator 11 is disposed adjacent the above-mentioned portion 6 for operating a pusher plate 14 for slidingly forwarding the aggregation of the hollow particulate inorganic material and serving also as a stopper for the molten metal in the mold cavity 13" in the mold 13. The metal mold 13 is arranged beneath the crucible 8 and has, on its upper wall, a thin-walled area 13' which is provided with many perforations 12 distributed over this area at a definite interval so as to permit a uniform injection of the molten metal over this area into the aggregation 16 in the mold cavity 13" in order to prevent unequal local concentration of the hollow particles in the aggregation 16 upon the injection of the molten metal.

In an alternative embodiment, the thin-walled area 13' is made of a molten metal permeable porous refractory material, such as unglazed pottery, with the pore channels for permeation of the molten metal having diameters adapted to permit the molten metal to be injected therethrough into the aggregation of the hollow particles of the inorganic material upon the pneumatic impression but not adapted to permit these hollow particles to intrude into the molten metal in the storage vessel.

The mold cavity 13" is defined by surfaces exhibiting sufficient resistances to heat, corrosion and wear and a self-lubricating property to leave a space of the sectional geometry corresponding to that of the composite product 17 to be molded and is filled with the hollow particulate inorganic material to build up an aggregation. To fill up this mold cavity 13" with a predetermined amount of the hollow particulate inorganicmaterial, a slidable pusher plate 14 is used, which is operated by the operator 11.

In the mold cavity 13", a composite product 17 of a hollow particulate inorganic material and a metal is molded. For taking the composite product 17 out of the mold, a drawer plate 21 having formed at its drawn end one or more dovetail recesses 18 is employed. The molded composite product 17 solidifies in the dovetail recess 18 and forms a disengageable but rigid joint therewith for slidingly drawing out the solidified product. The drawer plate 21 is operated by an operator 20 for operating the drawer plate 21. After the molded composite product 17 has been solidified in the mold cavity, it is slidingly forwarded by a combined operation of the pusher plate 14 and the drawer plate 21 by their operators 11 and 20 to a discharge station outside the mold, where it is removed from the dovetail recess and is taken up.

The manner of operation of the mold assembly of the first embodiment of the present invention is as follows.

The gas-tight lid 2 is settled in position by actuating the gas-tight lid operating cylinder 1 located above the molten metal storage vessel 5 to seal the crucible 8 thereof so as to permit to pressurize the gas space thereof. For preventing leakage of the compressed air, the gas-tight lid 2 is fixed to the storage vessel 5 by fixing members 3. After the lid 2 has been fixed, a compressed air is supplied to the gas space of the storage vessel 5 via an air path formed in the lid 2 to cause the molten metal 10 to be impressed pneumatically 9. The temperature of the molten metal stored in the crucible 8 is maintained by a heater 22 at a predetermined value. The temperature of the molten metal 10 and that of the surface thereof are detected by corresponding thermosensors (not shown). A hollow particulate inorganic material is introduced into the mold cavity 13" of the mold 13 from the hopper 4 and is guided through a preheating zone to a metal injection zone by the aid of the pusher plate 14, before it is compacted into an aggregation 16 of the particles [See FIG. 3(*a*)]. By the pneumatic impression 9 of the molten metal 10, it is introduced into the aggregation 16 of the particulate material through the perforations 12 formed in the thin-walled area 13' of the upper wall of the mold 13. After the aggregation 16 of the particulate material has been impregnated by the molten metal injected therein, the metal is cooled and solidified. Here, any noticeable inequality in the distribution of the mixing ratio of the metal to the particulate material is avoided, since the molten metal is injected from a large number of small perforations 12 and, therefore, under a uniform distribution over a wide area into the aggregation 16. Upon injection of the molten metal into the aggregation, the light-weighing hollow particles will tend to float up in the heavy-weighing molten metal. Nevertheless, the hollow particles will be caught by each other within the narrow stream in the thin perforation 12 and cannot float up before the aggregation has been impregnated with the molten metal.

The aggregation 16 is slidingly forwarded stepwise, as shown by the arrow 19, in the mold cavity at a predetermined sliding interval by the combined operation of the means (11, 20) for slidingly forwarding the aggregation, while being impregnated with the molten metal, and is caused to solidify as a composite molded product 17 after having passed the mold outlet. The extended composite molded product 17 is guided by combined operation of the operators 11 and 20 onto a conveyer before it reaches the discharge station, where the molded composite product is taken up by disengaging the dovetail joint by sliding the molded product 17 and the drawer plate 21 in vertical direction to each other.

The stroke of the stepwise forwarding of the extended molded product corresponds to the longitudinal length of the aggregation to be impregnated with the molten metal in a single step [See FIG.(b)]. The reciprocating motion of the operator 11 for the pusher plate 14 agrees completely with that of the operator 20 for the drawer plate 21 in respect of the stroke and timing. In each cycle of this synchronized motion, the impregnation of the aggregation with the molten metal through the perforations 12 by a pneumatic impression is repeated. Replenishment of the mold cavity with the hollow particulate inorganic material is effected on each retrogression stroke of the operator 11 for the pusher plate 14 by regulating the discharge gate of the hopper 4 to open. Replenishment of the storage vessel 5 with the molten metal is effected upon detection of arrival of the surface of the melt in the storage vessel 5 at a predetermined level by a melt level sensor disposed in the crucible 8, by which an electric signal is given out to cease the operations of the operators 11 and 20 temporarily and to exhaust the compressed air in the gas space of the storage vessel 5 out of it, whereupon the gas-tight lid 2 is lifted by operating the gas-tight lid operating cylinder 1 for starting the replenishment of the molten metal. While it is preferable to operate the above-described mold assembly continuously without cessation, the assembly may eventually be forced to be brought to out-of-operation for some periods of times by whatever reason. In this case, the operation of the mold assembly is continued until the molten metal in the crucible and in the mold cavity has been emptied completely, before the operation is stopped. For starting the operation again, the mold cavity is cleaned of the residual particulate material and is then filled with the fresh hollow particulate material under resetting of the pusher plate 14 and the drawer plate 21 at the start position, whereupon the crucible 8 is re-filled with the molten metal by pursuing the procedures as in the starting of the mold assembly, before the operation is started again.

The particulate inorganic material to be used according to the present invention is a hollow spherical particulate inorganic material, such as that obtained by calcinating the naturally occurring fine particulate Shirasu (a kind of volcano ejecta deposit) existing as one of abundant resources, or foamed glass beads. It has a bulk density of 0.3 to 0.4 $g/cm^2$ and a particle size of 0.3 to 2.5 mm.

Figure 5:
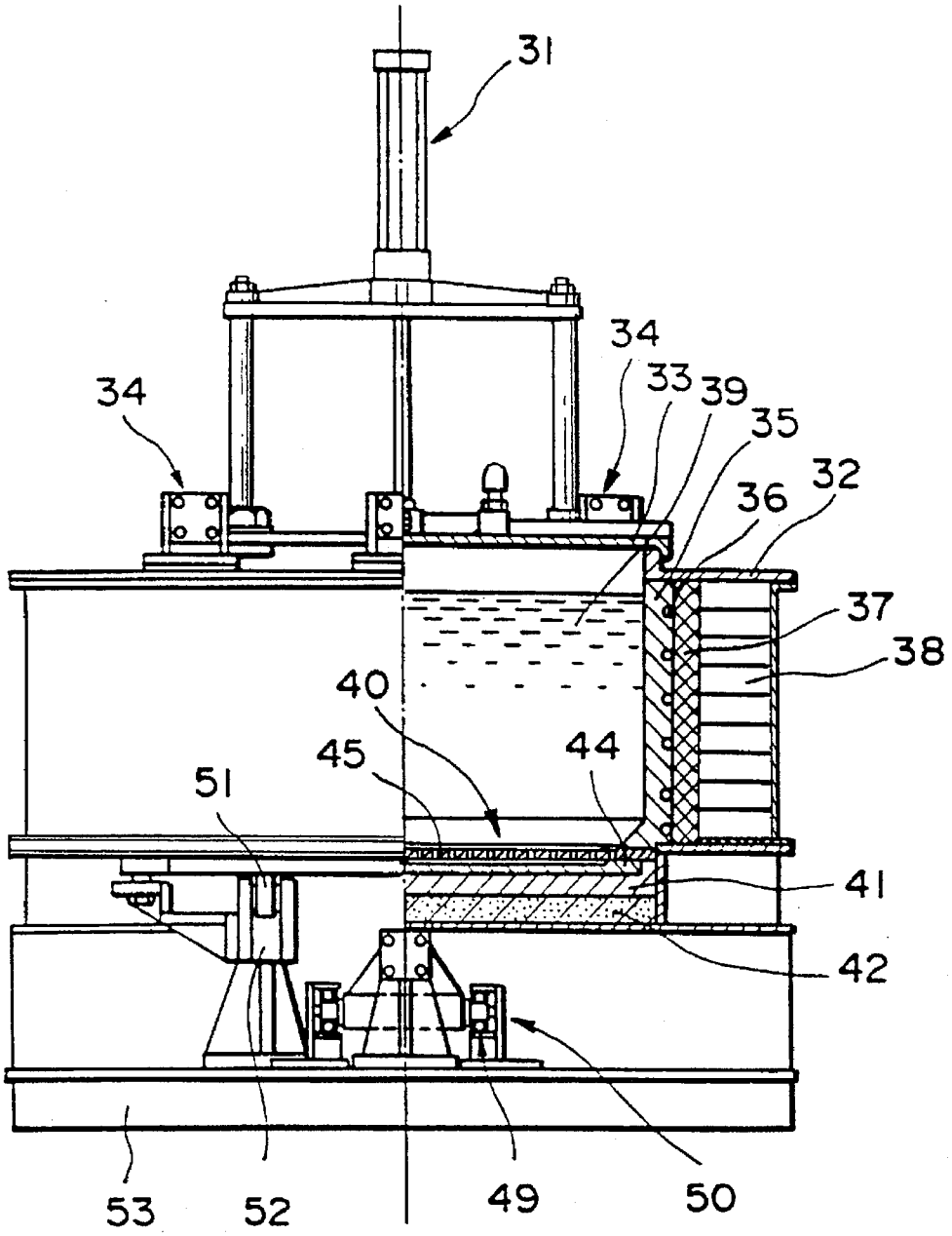
FIG. 5 shows the essential part of the second embodiment of the apparatus for producing a composite product of a hollow particulate inorganic material and a metal according to the present invention in a partly sectioned front view.
Figure 6:
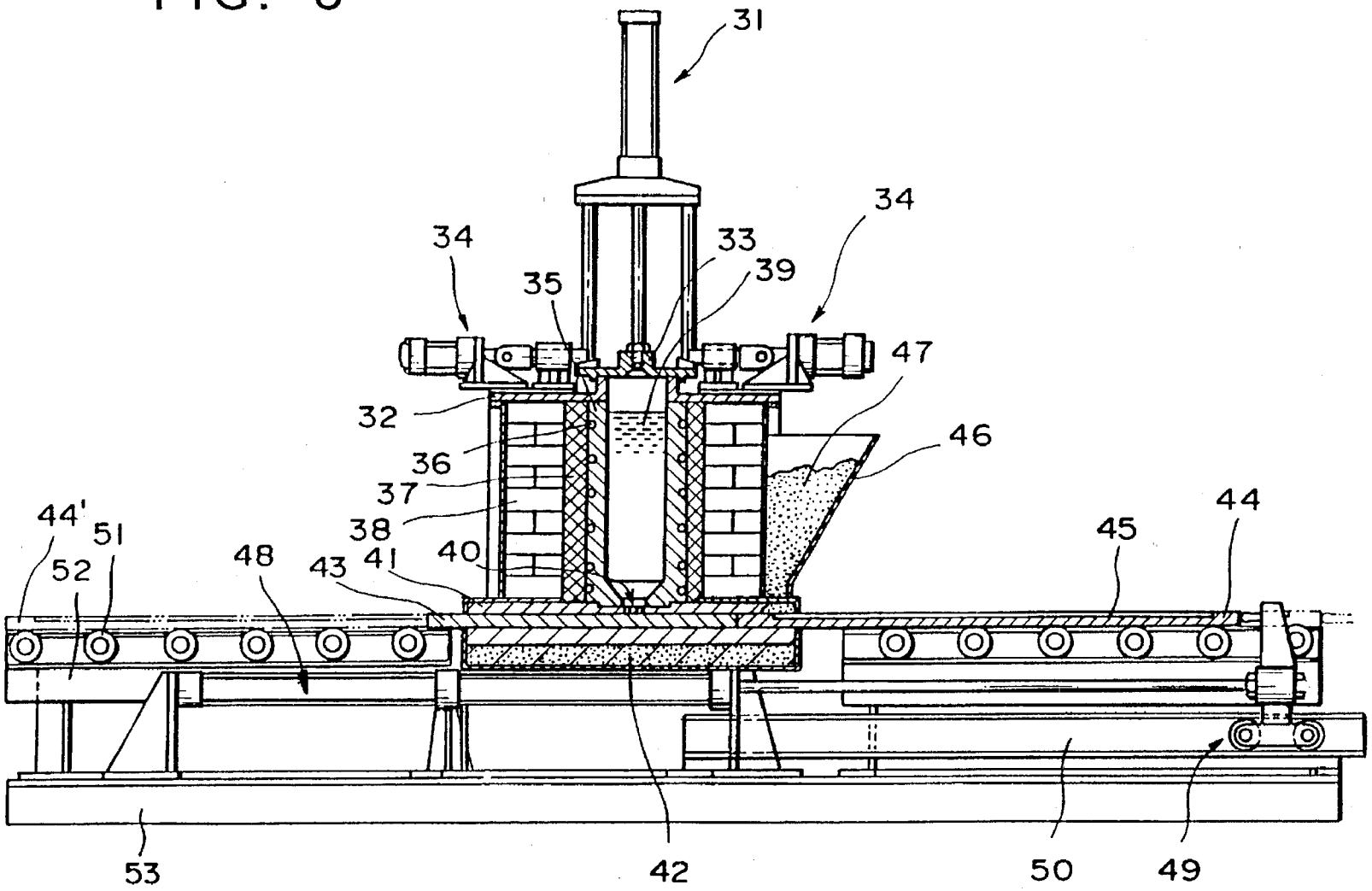
FIG. 6 is a side view of the apparatus of FIG. 5 in the central vertical section.

Now, the process for producing an extended composite product of a particulate inorganic material and a metal according to the present invention is described for the case of continuous production of the composite product using a horizontally laid mold assembly, based on the second embodiment thereof with reference to FIGS. 5 and 6.

In the apparatus as shown in FIGS. 5 and 6, a gas-tight lid operating cylinder 31 is arranged above a molten metal storage vessel 35 and is operable so as to impress a gas-tight lid 33 onto the rim ridge of a flange member 32 of the storage vessel 35 to realize a gas-tight seal of the storage vessel 35. On both sides of the gas-tight lid 33 are disposed each, opposingly to each other, a horizontal piston/cylinder arrangement 34 by which the lid 33 can be maintained under impression thereof onto the flange member 32. Around the storage vessel 35 is arranged a heater 36 and, outside thereof, a layer of a heat insulator 37. Outside the heat insulator, a pile of refractory bricks 38 surrounds the storage vessel assembly. The storage vessel 35 stores a molten metal 39.

Beneath the storage vessel 35, a horizontal mold is disposed which is composed of mold elements. The mold elements are composed of, on the one hand, a plurality of trough-formed mold bottom segments 44 connected to each other to form a mold bottom train slidably movable on a mold bed 41 and, on the other hand, a stationary perforated refractory plate 40 having many small perforations. The mold elements constitute a horizontal passage mold in the region beneath the stationary perforated refractory plate 40. The perforated refractory plate 40 is fitted to the open bottom of the molten metal storage vessel 35 so as to constitute a perforated bottom plate of the storage vessel 35 so that the perforations thereof permit the molten metal 39 to be injected into the mold cavity 45 of the mold therethrough. The perforated refractory plate 40 may be replaced by a molten metal permeable porous refractory plate, as explained in the first embodiment of the present invention hereinbefore. The mold bed 41 is supported on a stand 53 fixedly under an interposition of an insulator board 42. Each of the mold bottom segments 44 has the same geometry and profile and is provided on its upper face with a voluntarily designed (negative) surface relief pattern for imparting corresponding (positive) relief On the commencement of the molding operation using the above-described mold assembly, a solid dummy segment 43 having the same sectional contour geometry as the mold bottom segment is placed at the forehead of the train of the mold bottom segments 44 on the mold bed 41, in order to plug the perforations of the mold bottom segment to prevent free flowing down of the molten metal through them before the start of the molding. The solid dummy segment 43 can be forwarded slidingly on the mold bed 41 together with the succeeding mold bottom segments 44 and may have a voluntarily selected longitudinal length. The trailing end of the solid dummy segment 43 is tightly fitted to the front end of the forefront mold bottom segment 44 and, therefore, can slidably be forwarded on the mold bed 41 together with the subsequent mold bottom train. On forwarding the so-connected train of the solid dummy segment 43 and the following mold bottom segments 44 slidingly on the mold bed 41, the perforations in the stationary refractory plate 40 become open to the mold cavity above the succeeding mold bottom segment and the molten metal in the storage vessel 45 begins to spout into the mold cavity which has been filled with an aggregation of the hollow particulate inorganic material as described below. The solid dummy segment 43 is taken off from the mold bottom train after the dummy segment has reached a take-out station on the mold outlet side (the left side in FIG. 6).

The hollow particles of inorganic material supplied via suitable means, such as a conveyer (not shown), are stored in a hopper 46. The hollow particles are introduced via a gate opening of the hopper into the mold cavity 45 above the mold bottom segment 44 before it is forwarded to the position beneath the bottom of the molten The sliding movement of the mold bottom train is performed by means of a piston/cylinder arrangement 48. The piston rod thereof is provided at its terminal end with an engagement bracket supported on a wheeled support 49 movable in a guide groove 50 of a guide rail, with which the mold bottom train can be pushed slidingly forward (to the left of FIG. 6) on the inlet side guide way formed by guide rollers 51 and then on the mold bed 41 upon the forwarding stroke of the piston/cylinder arrangement 48. The mold bottom train is guided to an outlet side guide way formed by the guide rollers 51, after passing through the mold outlet. The guide rollers 51 are supported on a guide roller supporting bracket 52 supported on the stand 53.

In the production of a molded product of a composite of a metal and a hollow particulate inorganic material using the above-described mold assembly, as shown in FIG. 6, the hollow particulate inorganic material supplied via a suitable means, such as a belt conveyer (not shown) is once stored in a hopper 46, from which it is introduced into the mold cavity 45 above the mold bottom segment 44 before it is forwarded to the position beneath the bottom of the molten metal storage vessel 35. While the mold bottom train passes through the mold region beneath the stationary perforated refractory plate 40 at a constant velocity, the molten metal 39 in the molten metal storage vessel 35 is injected into the aggregation of the hollow particulate inorganic material formed in the extended mold cavity 45 on the mold bottom train. By impression of the molten metal 39 in the storage vessel 35 in a pneumatic way by, for example, supplying an inert gas or air to the gas space of the storage vessel 35, the injection of the molten metal through the fine perforations in the stationary refractory plate 40 is facilitated favorably, whereby a uniform composite product of the metal and the hollow particulate inorganic material is molded in a plate-like form with a voluntarily designed surface profile pattern. Thus, any contemplated voluntarily designed surface profile pattern of a definite size can be obtained.

Figure 7:
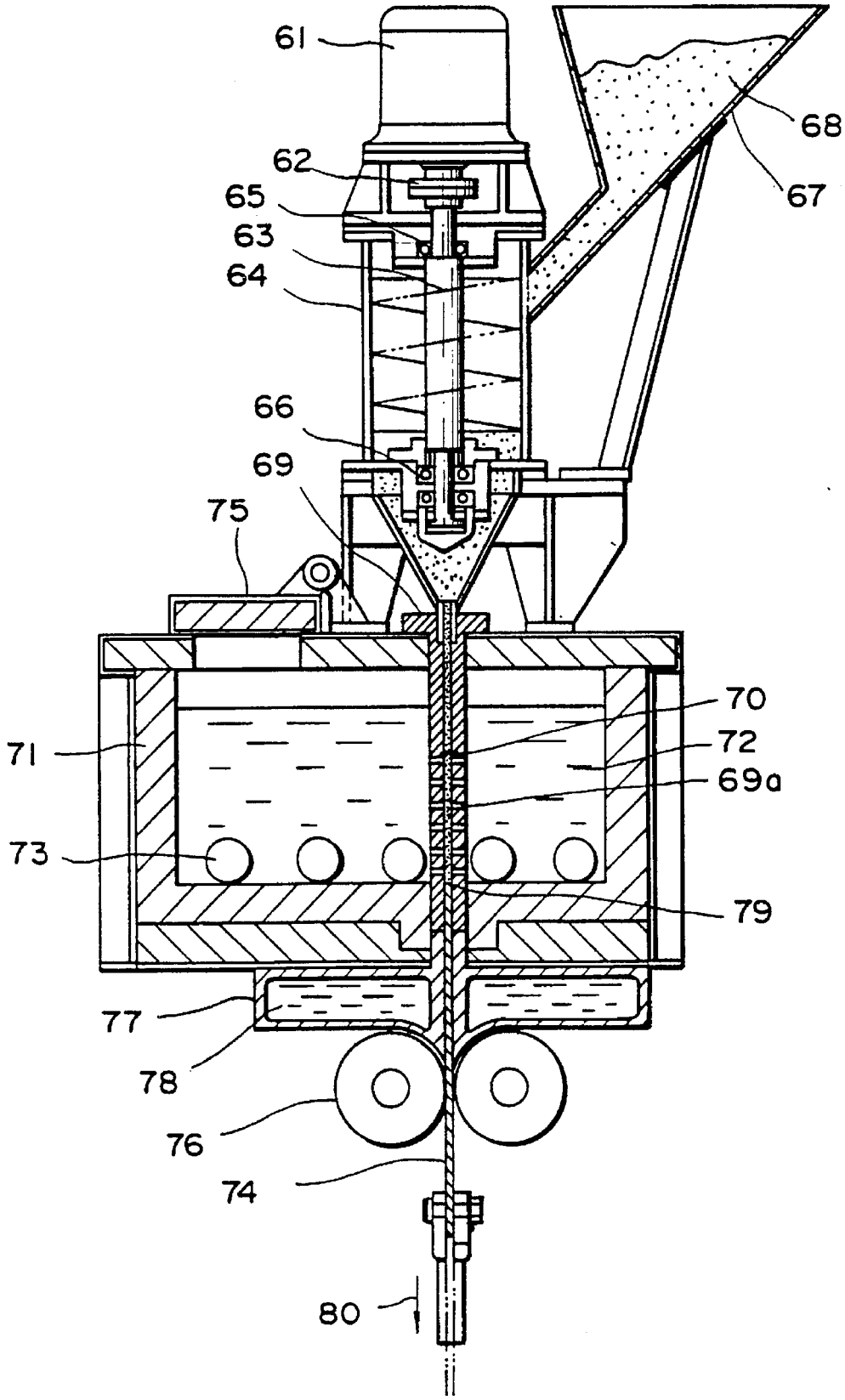
FIG. 7 shows the third embodiment of the apparatus for producing a composite product of a particulate inorganic material and a metal according to the present invention in a vertical section.
Figure 8:
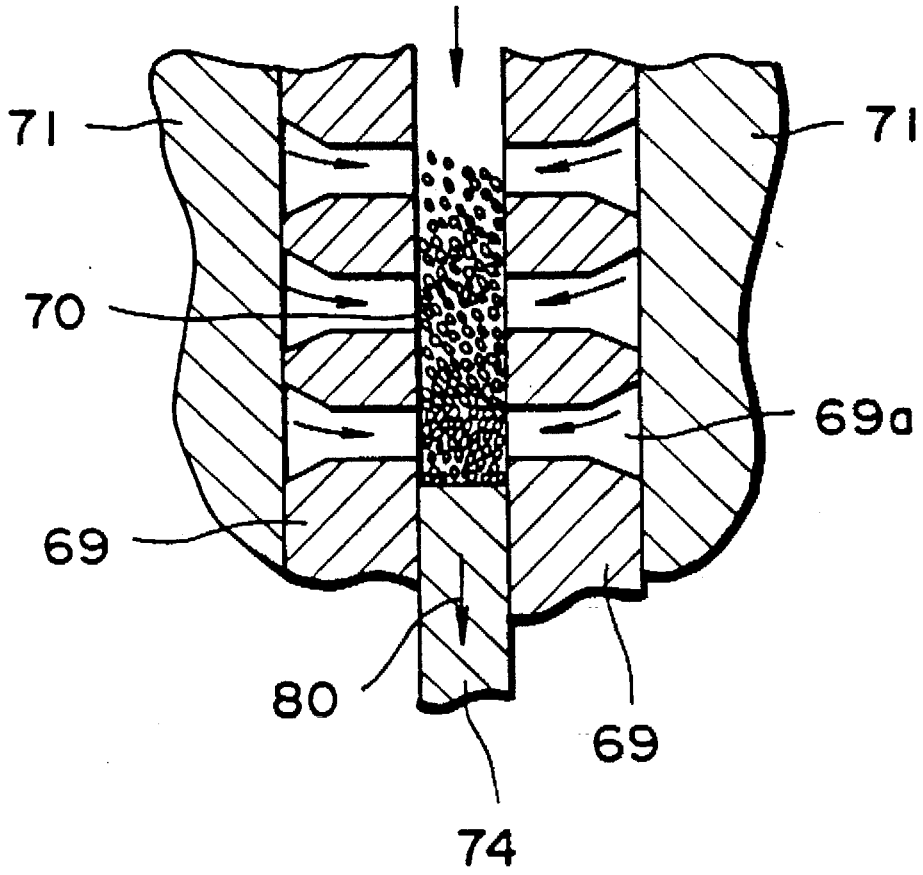
FIG. 8 shows the state of charging of the mold cavity with the particulate inorganic material and injection of molten metal thereinto in the apparatus of FIG. 7 in a partial enlargement.

Now, the process for producing a composite product of a particulate inorganic material and a metal according to the present invention is further described for the case of continuous production using a mold assembly provided with a stationary extended passage mold having many perforations and immersed in a molten metal storage vessel, based on the third embodiment thereof with reference to FIGS. 7 and 8.

The mold assembly is provided on a stand (not shown) with a molten metal storage vessel 71, on which a hollow particulate inorganic material charger unit 64 provided with a charging screw driven by an electric motor 61 is mounted by a support. The screw shaft 63 of the screw is connected with the electric motor 61 disconnectably via a joint 62. The screw shaft 63 is supported rotatably on the casing of the charger unit 64 by bearings 65 and 66 disposed at its upper and lower portions, respectively.

The charger unit 64 is provided, supported on the storage vessel 71, with a hopper 67 for supplying the hollow particulate inorganic material 68. The hollow particulate inorganic material 68 is guided by the screw into the inner chamber thereof and is forced by the screw into the inlet of the extended passage mold 69, which extends down vertically from the discharge end of the charger unit 64.

The passage mold 69 may be in a form of a flat conduit with a plate-formed internal passage way as the mold cavity or in a form of a tube with an internal passage way of a cylindrical, rectangular or polygonal cross-section as the mold cavity and is supported on the upper wall of the molten metal storage vessel 71 by a flange formed at the inlet thereof. The passage mold 69 is immersed in the molten metal 72 in the molten metal storage vessel 71 at the lower region provided with many small perforations and is supported at its lower end portion tightly in an opening penetrating the bottom wall of the vessel 71. Beneath the molten metal storage vessel 71 is arranged, surrounding the lower part of the extended passage mold 69, a cooling jacket 77, through which a cooling water is circulated by a circulation pump (not shown). Below the cooling jacket 77, a pair of guide rollers 76 are arranged, between which the cooled and solidified molded composite product discharged from the outlet of the extended passage mold 69 is pinched and towed downwards. The front end of the molded composite product which is discharged out of the mold upon the beginning of the molding is connected with a dummy plate (or dummy rod) 74 to assist towing down of the molded product.

The extended stationary vertical passage mold 69 is provided with many small perforations 69*a* in its lower region immersed in the molten metal 72. Instead of the perforations, this region may be made of a molten metal permeable porous refractory material, as explained in the first and the second embodiment of the present invention. The molten metal storage vessel 71 is provided on its ceiling wall with a dismountable gas-tight lid 75 and along its side or bottom wall with a heater means 73 embedded in the wall for maintaining the requisite temperature of the molten metal 72 stored therein.

By this molding apparatus, the hollow particulate inorganic material is supplied continuously to the extended vertical passage mold 69 from hopper 67 through the screw charger unit 64 by rotating the screw shaft 63 by the electric motor 61 via the disengageable joint 62 and is forced into the mold inlet through a conically converging guide horn of the charger unit 64. The hollow particulate inorganic material forced into the passage mold 69 by the screw builds up therein an aggregation of the particles, which is guided down by the wedging action by the screw charger together with a towing action of the pair of guide rollers 76 and reaches the heating zone surrounded by the molten metal 72, where the molten metal 72 is injected through the fine perforations distributed over this zone into the aggregation inside the mold cavity 70 of the mold 69. The molten metal injected into the aggregation of the hollow spherical particles penetrates through the interstices between the particles and fills up these interstices to form a composite mixture of the metal and the particulate inorganic material (See FIG. 8). This composite mixture descends within the mold cavity through the cooling zone thereof, where it is cooled and solidified by the cooling water 78 in the cooling jacket 77 into the molded composite product, which is towed down by the guide rollers 76. In FIG. 7, the molded composite mixture is shown in the mold cavity at a position at which it is brought into connection with the trailing end 79 of the dummy plate 74 inserted into the mold cavity.

Figure 9:
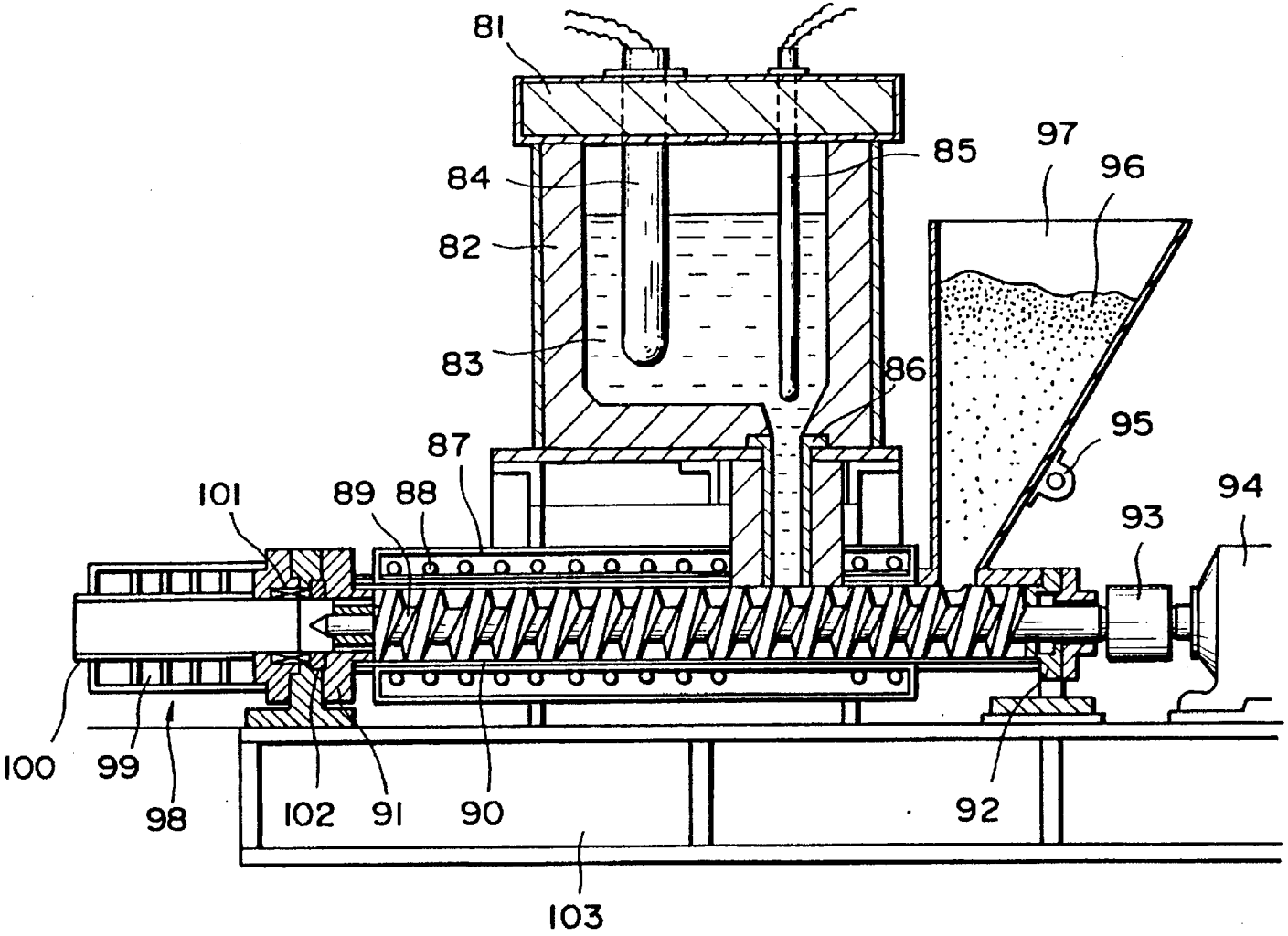
FIG. 9 shows the fourth embodiment of the apparatus for producing a composite product of a particulate inorganic material and a metal according to the present invention in a vertical side section.

Finally, the process for producing an extended product of a composite of a metal and a particulate inorganic material according to the present invention is described for the case of continuous production of the composite product which has a relatively greater bulk thickness, such as a board, cylinder, block or so on, using a molding apparatus including a high-temperature mixer extruder, based on the fourth embodiment thereof with reference to FIG. 9.

The molding apparatus according to the fourth embodiment as shown in FIG. 9 is mounted on a stand 103 and includes a storage vessel 82 having a gas-tight lid 81 for storing a molten metal, such as aluminum etc. The gas-tight lid 81 can be assembled or disassembled by a lid assemblage piston/cylinder arrangement (not shown). For heating the molten metal at a temperature slightly above the melting point of the metal, a heating means 84 is installed in the molten metal storage vessel 82 under penetration through the gas-tight lid 81 and extending submerged under the molten metal 83. A thermosensor 85 is inserted in a protective sheath fixed arranged in the gas-tight lid 81 in a gas-tight fashion so as to submerge its top end beneath the level of the molten metal 83 for detecting the temperature of the molten metal 83 in the storage vessel 82. The molten metal storage vessel 82 communicates, via a graphite discharge nozzle 86 inserted in the bottom wall thereof, to a horizontally laid high-temperature mixer extruder of a screw conveyer-like construction constituted essentially of a screw 89 and a refractory casing cylinder 90 encasing the screw and made of, for example, graphite, so as to permit the molten metal to be introduced into the mixing space of the mixer extruder between the casing cylinder 90 and the screw 89. The high-temperature mixer extruder is supplied also with the hollow particulate inorganic material at a portion upstream the position where the grafite discharge socket 86 opens into the casing cylinder 90 of the mixer extruder. The molten metal and the hollow particulate inorganic material introduced into the high-temperature mixer extruder are mixed in the mixing space thereof by a kneading action caused by rotation of the screw 89.

Encased in a reinforcing steel sleeve, a heating means 88, such as a high-frequency coil, is arranged surrounding the refractory casing cylinder 90 for maintaining the temperature of the kneaded mixture within the casing cylinder 90 and is covered by a layer of heat insulator for preventing dissipation of the heat from the kneaded mixture, which is further covered by a coverage case 87.

The discharge end of the screw shaft is rotatably supported at the discharge end in a front end bearing 91 and at the opposing rear end by a rear end bearing 92, respectively. The front end and the rear end bearings are supported fixedly on the stand 103. The screw shaft is connected at its rear end, via a coupling 93 and a gearing, with a driving shaft of an electric motor 94 to permit a continuous operation of the screw 89.

The hollow particulate inorganic material is supplied to the high-temperature mixer extruder from a hopper 97 disposed above the mixer extruder at a portion upstream the supply inlet for the molten metal through a controllable gate. The hopper 97 is supplied with the hollow particulate inorganic material, such as "Shirasu balloons", which are obtained as a calcined product of a volcano ejecta deposit and have a bulk density of 0.3–0.5 g/ml$^3$, from a preheating kiln (not shown) at a temperature of about 350°–400° C. and is provided with an air-vibrator 95 for facilitating a smooth charging of the particulate material 96 into the mixer extruder and a preheater (not shown) for preheating the particulate material up to about 350°–400° C., before it is introduced into the mixer extruder.

The front bearing 91 for pivoting the discharge end of the screw shaft is provided with a plurality of openings for permitting extrusion of the kneaded mixture from the mixing space into a shaping unit 100 bodily connected with the mixer extruder. The shaping unit 100 may consist of a shaping sleeve having a rectangular cross section, the internal space of which may be connected to the mixing space of the screw kneader of the cylindrical mixer extruder via a graphite bearing 101 having a rectangular cross section. The shaping unit 100 is surrounded by a cooling jacket 98, in which a helical duct is formed for circulating a cooling water 99. Upon passage of the kneaded mixture through the shaping unit 100, it is cooled and solidified to leave a shaped composite product. In the region between the front end bearing 91 of the screw 89 and the graphite bearing 101, there is provided a thermosensor 102 for detecting the temperature of the kneaded composite mixture. The sensor serves to insure that the temperature is maintained within a permissible range. The shaping unit 100 can be connected with a transfer means for guiding out the shaped composite product of the metal and the hollow particulate material.

According to the present invention, it is possible to produce, in the first place, a relatively thin, light-weighing composite board of larger surface area in which the particles of the hollow inorganic material are uniformly distributed for use as elements for construction purposes, such as wall board, ceiling, floor board etc. By using Shirasu-balloons as the hollow particulate inorganic material, the present invention can contribute to a development in utilization of useful and economical resources and, by using hollow glass beads, it contributes to a development in the recycled utilization of glass.

In the second place, it is able according to the present invention to obtain relatively thin, non-flammable light-weighing composite boards of larger surface areas exhibiting a uniform distribution of the material properties for use as construction elements, such as wall boards, ceiling, floor boards and so on, having a voluntarily designed surface profile pattern, whereby the application fields are broadened. By using Shirasu-balloons as the hollow particulate inorganic material, the present invention can participate in a development in the utilization of useful and economical resources and, by using hollow glass beads, it contributes to a development in the recycled utilization of glass. The process according to the present invention is adapted for producing an extended composite board which is in particular suited for producing a high quality composite board having a voluntarily designed surface pattern, since the mold bottom can be composed of a plurality of mold bottom segments connectable with each other into a mold bottom train capable of being forwarded slidingly on a guide way or on a mold bed successively.

In the third place, it is able according to the present invention to obtain composite boards of a metal and a hollow particulate inorganic material, continuously and relatively high thorough-put rate in a vertical material flow, wherein a densely combined composite product is formed continuously by installing a vertically extending passage mold passing through a molten metal storing vessel in the mold cavity of which an aggregation of the particulate inorganic material is forcedly guided downwards successively, wherein a molten metal permeable region of the vertical passage mold which is provided with many small perforations or which is made of a porous refractory material is held immersed in the molten metal layer in the storage vessel so as to permit the molten metal to be injected therethrough into the mold cavity.

In the fourth place, it is able to obtain according to the present invention a light-weighing non-inflammable composite product of a metal and a hollow particulate inorganic material having a uniform distribution of the particles of the inorganic material with a relatively greater bulk thickness adapted for use as a stout element for interior installations in architecture, such as pillars, floor boards, ceiling and so on, by installing a mixer extruder for kneading the molten metal and the hollow particulate inorganic material efficiently and continuously. It brings about many advantages especially in a tall building due to its light-weighing property (a bulk density of less than 1.5 g/cm$^3$). When hollow glass beads (G-light) are used as the hollow particulate material, it can contribute to recycled utilization of glass resources. When Shirasu-balloons, a calcined product of a volcano ejecta deposit, are employed as the hollow particulate material, it participate in development in utilization of useful resources and contributes to a development of new industry.

I claim:

1. A process for producing an extended relatively thin composite product of a metal and a hollow particulate inorganic material using a mold assembly constituted essentially of a mold (13) enclosing a mold cavity (13") subdivided at equal intervals into an entrance section, a central section and an exit section each having a geometry corresponding to that of an extended composite product (17); a means (4, 14) for charging the entrance section of the mold cavity (13") with the hollow particulate inorganic material; a means (11, 20) for forwarding a resulting aggregation (16) slidingly stepwise successively from the entrance section to the central and the exit sections and, finally, to the outside of the mold (13); a storage vessel (8) for storing the metal in a molten state; a permeable perforated or porous refractory plate (13') located on one side of the extension of the mold cavity (13") and adjoining to the molten metal (10) in said storage vessel (8); and a means (18, 20, 21) for taking the molded composite product (17) out of the mold (13), said process comprising repeating the process steps of filling up the entrance section of the mold cavity with the hollow particulate inorganic material to build up an aggregation of the particulate inorganic material therein in a form corresponding to the mold cavity of the entrance section, forwarding this aggregation slidingly stepwise, first, to the central section of the mold cavity, injecting the molten metal into the particle aggregation in the central section of the mold cavity through the permeable perforated or porous refractory plate to cause the molten metal to penetrate the aggregation through the interstices between the particles of said aggregation of the hollow particulate inorganic material pneumatically impressing the molten metal in the molten metal storage vessel, while re-filling the now vacant entrance section with fresh hollow particulate inorganic material, forwarding the aggregation then found in the central section and now impregnated with the molten metal slidingly stepwise to the exit section of the mold cavity, while repeating the above re-filling and injecting steps, cooling, thereafter, the resulting molded product in the exit section of the mold cavity to solidify it into the extended product of the composite of metal and hollow particulate inorganic material, forwarding the aggregations then in the three sections slidingly stepwise further to move the solidified product to the outside of the mold, while repeating the above process steps, and taking the finished molded composite product out of the mold assembly in the discharge station.

2. A process for producing an extended relatively thin product of a composite of a metal and a hollow particulate inorganic material having a voluntarily designed surface relief pattern, successively using a mold assembly constituted essentially of mold elements (44, 40) enclosing a mold cavity (45) having a profile geometry corresponding to that of the extended product of the composite and composed of, on the one hand, a plurality of mold bottom segments (44) slidably movable on a mold bed (41) and on an inlet side and an outlet side mold guide ways, respectively, and, on the other hand, a permeable stationary perforated or porous refractory plate (40); a means (46) for charging the mold cavity (45) with the hollow particulate inorganic material (47); and a storage vessel (35) for storing molten metal (39), with its bottom being constituted of said molten metal permeable refractory plate (40), said process comprising, under repetition, the process steps of laying the mold bottom segments (44) serially on the mold bed (41) to form a mold bed train, filling up the mold cavity (45) on the mold bottom segment (44) at the mold inlet with the hollow particulate inorganic material to build up an aggregation of the hollow particulate inorganic material in a form corresponding to the mold cavity, forwarding the mold bottom train (44) slidingly on the mold guide ways and on the mold bed (41) together with the aggregation of the hollow particulate inorganic material towards the mold outlet, injecting the molten metal into the mold cavity (45) through the permeable perforated or porous refractory plate (40) constituting the bottom of the molten metal storage vessel (35) by pneumatically impressing the molten metal in the molten metal storage vessel (35), to cause the molten metal to penetrate the aggregation through the interstices between the particles of the aggregation, taking out the molded extended composite product impregnated with the molten metal from the mold bottom segment left the mold as the mold bottom segment moves on, and removing the foremost mold bottom segment now freed from the molded composite product at the mold outlet end from the outlet side mold guide way and laying it again on the inlet side mold guide way to supplement the mold bottom train.

3. A process for producing an extended product of a composite of a metal and a hollow particulate inorganic material in a form of a board, cylinder or block, in a continuous way with continuous charging of the hollow particulate inorganic material using a mold assembly constituted essentially of a stationary passage mold (69) enclosing an extended mold cavity (70) and a molten metal storage vessel (71), a molten metal injection zone of a permeable perforated or porous part, with its perforations or pore channels being distributed over this zone, immersed in the molten metal for permitting injection of the molten metal into the mold cavity (70) therethrough but preventing said hollow particulate inorganic material from flowing said therethrough and a cooling zone in a mold exit end portion; an assembly for charging the mold cavity (70) with said hollow particulate inorganic material at a mold inlet; and a towing means for pulling down the resulting extended composite product to be discharged out of the mold, said process comprising the steps of charging the mold cavity (70) at the mold inlet with the hollow particulate inorganic material to build up an aggregation of the particulate inorganic material in a cross-sectional profile corresponding to that of the mold cavity (70), forwarding the resulting aggregation of the particulate inorganic material slidingly towards the mold exit by the action of the towing means, injecting the molten metal into the mold cavity (70) through the permeable perforated or porous part of the passage mold (69) to cause the molten metal to penetrate the aggregation of the hollow particulate inorganic material though the interstices between the particles of the aggregation by a static pressure head of the molten metal in the molten metal storage vessel (71) and, if necessary, under a pneumatic pressure control in the molten metal storage vessel (71), cooling the aggregation impregnated with the molten metal in a cooling zone of the stationary mold (69) to solidify it and taking the so-solidified extended composite product out of the mold (69) via the towing means.

4. An apparatus for producing an extended relatively thin composite product of a metal and a hollow particulate inorganic material, comprising a mold assembly which comprises a mold (13) enclosing a mold cavity (13") of a geometry corresponding to that of the extended composite product (17), a means (4, 14) for charging the mold cavity (13") with the hollow particulate inorganic material to fill it up and to shape into an aggregation (16) of the hollow particulate inorganic material, a means (11, 20) for slidingly forwarding the aggregation of the hollow particulate inorganic material from a charging end to a discharge station of the mold assembly, a storage vessel (8) for storing the metal in a molten state and adapted to be pneumatically impressed for effecting injection of the molten metal into the mold cavity (13") , a permeable perforated or porous refractory plate (13') for injecting the molten metal therethrough into the aggregation (16) of the hollow particulate inorganic material in the mold cavity (13"), said plate being located on one side of an extension of the mold cavity and adjoining to the molten metal (10) in said storage vessel (8), with its molten metal permeable perforations (12) or pore channels being distributed over the plate (13'), said perforations or pore channels each having a diameter adapted to permit the molten metal to be injected therethrough into the aggregation (16) upon the pneumatic impression but adapted not to permit the hollow particles of the inorganic material in the aggregation to intrude into the molten metal (10) in said storage vessel (8) and a means (18, 20, 21) for taking the molded composite product (17) out of the mold cavity (13") at the discharge station wherein the mold cavity (13") is defined by a pair of slidable stopper members (14, 21) inserted in a guide path within the mold (13) and movable in synchronism with each other and wherein the pair of slidable stopper members (14, 21) serves as the means for slidingly forwarding the aggregation.

5. An apparatus as claimed in claim 4, wherein a starting dummy bar (74) is held inserted slidably in the mold cavity (70) before the start of operation of the apparatus.

6. An apparatus for producing an extended relatively thin composite product of a metal and a hollow particulate inorganic material in a continuous way, comprising a mold assembly which comprises a mold (13) enclosing a mold cavity (13") subdivided at an equal interval into an entrance section, a central section and an exit section each having the same profile geometry as that of the extended product (17), a means (4, 14) for charging the entrance section of the mold cavity (13") with the hollow particulate inorganic material to fill it up and to build up an aggregation (16) of the hollow particulate inorganic material therein, a means (11, 20) for slidingly forwarding stepwise the aggregation of the hollow particulate inorganic material in the entrance section successively to the central and the exit sections of the mold cavity (13") and, finally, to a discharge station of the mold assembly, a storage vessel (8) for storing the metal in a molten state, located adjacent the mold cavity (13") and adapted to be pneumatically impressed for effecting injection of the molten metal into the central section of the mold cavity (13"), a permeable perforated or porous refractory plate (13') for injecting the molten metal therethrough into the aggregation (16) of the hollow particulate inorganic material in the mold cavity (13"), perforated or porous plate being disposed on one side of an extension of the mold cavity (13") and adjoining to the molten metal (10) in said storage vessel (8), with its molten metal permeable perforations (12) or pore channels being distributed over the plate (13') and each having a diameter adapted to permit the molten metal to be injected therethrough into the aggregation (16) upon the pneumatic impression but adapted not to permit the hollow particles of the inorganic material in the aggregation to intrude into the molten metal (10) in said storage vessel (8) and a means (18, 20, 21) for taking the molded composite product (17) out of the mold cavity (13") at the discharge station wherein the mold cavity (13") is defined by a pair of slidable stopper members (14, 21) inserted in a guide path within the mold (13) and movable in synchronism with each other and wherein the pair of slidable stopper members (14, 21) serves as the means for slidingly forwarding the aggregation.

7. An apparatus as claimed in claim 4 or 6, wherein the pair of slidable stopper members (14, 18) is composed of a pusher plate (14) and a towing plate (21) having a dovetail recess (18) designed to be disengageable from the solidified molded composite product (17).

8. An apparatus for producing an extended relatively thin product of a composite of a metal and a hollow particulate inorganic material having a voluntarily designed surface relief pattern successively, comprising a mold assembly which comprises mold elements (44, 40) enclosing a mold cavity (45) having a profile geometry corresponding to that of the extended product of the composite and composed of a plurality of mold bottom segments (44), which are arranged in a tight but separable fitting with each other to build up a trough-formed mold bottom slidable on a mold bed (41) and on mold guide ways subsequent to and continuing to the mold bed, respectively, and each of which has a voluntarily designed surface relief pattern on the upper face thereof, and a molten metal permeable stationary perforated or porous refractory plate (40) defining the upper limit of the mold cavity (45), a means (46) for charging the mold cavity (45) with said hollow particulate inorganic material to build up an aggregation of the hollow particles of the inorganic material in the mold cavity (45), a means (48, 49; 50, 51) for forwarding the mold bottom slidingly on the mold guide ways and on the mold bed (41) together with said aggregation of the particulate inorganic material carried thereon from the inlet side to the outlet side of the mold assembly, a storage vessel (35) for storing the molten metal disposed on the molten metal permeable stationary perforated or porous refractory plate (40) and adapted to be pneumatically impressed for effecting injection of the molten metal into the mold cavity charged with the aggregation of the hollow particulate inorganic material through the molten metal permeable stationary perforated to porous refractory plate (40), with the perforations or pore channels being distributed over the plate (40) and each having a diameter adapted to permit the molten metal to be injected therethrough into the aggregation of the particles of the inorganic material upon the pneumatic impression of the molten metal but not adapted to permit the particles of the inorganic material to intrude into the molten metal in the storage vessel, and a means (18, 20, 21) for taking out the molded extended composite product from the mold bottom segment moved and left the mold cavity (45) on the mold bed (41).

9. An apparatus as claimed in claim 8, wherein one of said plurality of mold bottom segments (44) is replaced by a solid flat board (43) served as a closure member for blocking up passage of the molten metal through the perforated plate (40) before the start of the operation of the apparatus.

10. An apparatus as claimed in claim 8 or 9, wherein each of said plurality of mold bottom segments (44) is designed to permit to be dis- and re-mounted on and from the mold bed (41), so that the foremost segment dismounted from the mold bed (41) is re-mounted on the charge side of the mold assembly.

11. An apparatus as claimed in claim 8 wherein a piston/cylinder arrangement (48) is used for the means for forwarding the mold bottom segments.

12. An apparatus as claimed in claim 8, wherein the mold bottom segments (44) are forwarded on the mold bed (41) at a constant velocity.

13. An apparatus as claimed in claim 11 wherein a support guide (50) for moving the piston/cylinder arrangement (48) is employed for forwarding the mold bottom segments (44).

14. An apparatus as claimed in claim 9 wherein a piston/cylinder arrangement (48) is used for the means for forwarding the mold bottom segments.

15. An apparatus as claimed in claim 10 wherein a piston/cylinder arrangement (48) is used for the means for forwarding the mold bottom segments.

16. An apparatus as claimed in claim 9 wherein the mold bottom segments (44) are forwarded on the mold bed (41) at a constant velocity.

17. An apparatus as claimed in claim 10 wherein the mold bottom segments (44) are forwarded on the mold bed (41) at a constant velocity.

18. An apparatus as claimed in claim 14 wherein the mold bottom segments (44) are forwarded on the mold bed (41) at a constant velocity.

19. An apparatus as claimed in claim 11 wherein the mold bottom segments (44) are forwarded on the mold bed (41) at a constant velocity.

20. An apparatus as claimed in claim 15 wherein the mold bottom segments (44) are forwarded on the mold bed (41) at a constant velocity.

21. An apparatus as claimed in claim 12 wherein a support guide (50) for moving the piston/cylinder arrangement (48) is employed for forwarding the mold bottom segments (44).

22. An apparatus as claimed in claim 14 wherein a support guide (50) for moving the piston/cylinder arrangement (48) is employed for forwarding the mold bottom segments (44).

23. An apparatus as claimed in claim 15 wherein a support guide (50) for moving the piston/cylinder arrangement (48) is employed for forwarding the mold bottom segments (44).

24. An apparatus as claimed in claim 16 wherein a support guide (50) for moving the piston/cylinder arrangement (48) is employed for forwarding the mold bottom segments (44).

25. An apparatus as claimed in claim 17 wherein a support guide (50) for moving the piston/cylinder arrangement (48) is employed for forwarding the mold bottom segments (44).

26. An apparatus as claimed in claim 18 wherein a support guide (50) for moving the piston/cylinder arrangement (48) is employed for forwarding the mold bottom segments (44).

27. An apparatus as claimed in claim 19 wherein a support guide (50) for moving the piston/cylinder arrangement (48) is employed for forwarding the mold bottom segments (44).

28. An apparatus as claimed in claim 20 wherein a support guide (50) for moving the piston/cylinder arrangement (48) is employed for forwarding the mold bottom segments (44).

* * * * *

UNITED STATES PATENT AND TRADEMARK OFFICE

CERTIFICATE OF CORRECTION

PATENT NO. : 5,657,815

DATED : August 19, 1997

INVENTOR(S) : Nobuhiro Sugitani

It is certified that error appears in the above-identified patent and that said Letters Patent is hereby corrected as shown below:

On the title page, Item [30], line 5, list the Priority Document to read as follows:

--May 15, 1995 [JP] Japan.....7-116155--

Signed and Sealed this

Twenty-eighth Day of October, 1997

Bruce Lehman

*Attest:*

BRUCE LEHMAN

*Attesting Officer*

*Commissioner of Patents and Trademarks*